US010815818B2

(12) United States Patent
Propheter-Hinckley et al.

(10) Patent No.: US 10,815,818 B2
(45) Date of Patent: Oct. 27, 2020

(54) VARIABLE-PITCH VANE ASSEMBLY

(71) Applicant: United Technologies Corporation, Farmington, CT (US)

(72) Inventors: Tracy A. Propheter-Hinckley, Manchester, CT (US); Raymond Surace, Newington, CT (US); Robert L. Hazzard, Windsor, CT (US); Mark Borja, Palm Beach Gardens, FL (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 570 days.

(21) Appl. No.: 15/653,064

(22) Filed: Jul. 18, 2017

(65) Prior Publication Data

US 2019/0024530 A1 Jan. 24, 2019

(51) Int. Cl.
*F01D 17/16* (2006.01)

(52) U.S. Cl.
CPC ..... *F01D 17/162* (2013.01); *F05D 2230/60* (2013.01); *F05D 2240/128* (2013.01); *F05D 2260/30* (2013.01); *F05D 2260/50* (2013.01)

(58) Field of Classification Search
CPC ..... F01D 17/162; F05D 2260/30; F05D 2260/50; F05D 2240/128; F05D 2230/60
See application file for complete search history.

(56) References Cited

U.S. PATENT DOCUMENTS 3,584,857 A * 6/1971 Hipsher ..... F16F 1/38 267/281
3,788,763 A * 1/1974 Nickles ..... F01D 17/162 415/147
4,826,399 A * 5/1989 Perez ..... F01D 17/162 415/148
4,979,874 A * 12/1990 Myers ..... F01D 7/00 415/160
5,024,580 A * 6/1991 Olive ..... F01D 17/162 415/150
5,314,301 A 5/1994 Knight
(Continued)

FOREIGN PATENT DOCUMENTS

EP 3085967 A1 10/2016
WO 2015026420 A1 2/2015

OTHER PUBLICATIONS

European Search Report for application EP 18173370.0, dated Sep. 21, 2018, 7 pages.

*Primary Examiner* — Joseph J Dallo
(74) *Attorney, Agent, or Firm* — Cantor Colburn LLP

(57) ABSTRACT

A variable-pitch vane assembly for a gas turbine engine includes a sync ring, a vane having a vane arm, and a pin installed through the sync ring and through the vane arm. The pin includes an anti-rotation notch located along a pin shaft. An anti-rotation spacer is engaged with the pin at the anti-rotation notch to prevent rotation of the pin. A turbine section of a gas turbine engine includes a turbine rotor and a turbine stator. The turbine stator includes one or more variable-pitch vane assemblies including a sync ring, a vane having a vane arm, and a pin installed through the sync ring and through the vane arm. The pin includes an anti-rotation notch located along a pin shaft. An anti-rotation spacer is engaged with the pin at the anti-rotation notch to prevent rotation of the pin.

14 Claims, 8 Drawing Sheets

(56) References Cited

U.S. PATENT DOCUMENTS 5,387,080 A * 2/1995 Bouhennicha ..... F01D 17/162 415/150
5,492,446 A * 2/1996 Hawkins ..... F01D 17/162 411/116
5,593,275 A * 1/1997 Venkatasubbu ..... F01D 17/162 415/160
5,601,401 A * 2/1997 Matheny ..... F01D 17/162 415/160
5,672,047 A * 9/1997 Birkholz ..... F01D 9/065 415/160
6,799,945 B2 * 10/2004 Chatel ..... F01D 17/162 415/156
6,860,450 B2 * 3/2005 Muylaert ..... B64C 27/50 244/17.11
7,004,723 B2 * 2/2006 Raulin ..... F01D 17/162 415/160
7,011,494 B2 * 3/2006 Kies ..... F01D 17/162 415/148
7,530,784 B2 * 5/2009 Ribassin ..... F01D 17/16 415/160
8,668,444 B2 3/2014 Jarrett, Jr. et al.
9,057,455 B2 * 6/2015 Marocchini ..... F16K 31/521
10,364,828 B2 * 7/2019 Ikeguchi ..... F01D 17/162
10,393,145 B2 * 8/2019 Medina Cruz ..... F01D 17/162
2004/0062641 A1 * 4/2004 Pickens ..... F01D 17/16 415/160
2004/0115045 A1 * 6/2004 Alexander ..... F01D 17/162 415/165
2005/0008489 A1 * 1/2005 Perruchaut ..... F01D 17/16 416/160
2005/0129510 A1 * 6/2005 Raine ..... F01D 17/162 415/155
2006/0133890 A1 * 6/2006 Etoile ..... F16C 11/0614 403/122
2008/0050220 A1 * 2/2008 Merry ..... F01D 17/162 415/160
2010/0092278 A1 * 4/2010 Major ..... F01D 17/162 415/160
2010/0166540 A1 * 7/2010 Perez ..... F01D 17/162 415/148
2012/0076641 A1 * 3/2012 Jarrett, Jr. ..... F01D 17/162 415/160
2012/0076658 A1 * 3/2012 Jarrett, Jr. ..... F01D 17/162 416/205
2012/0195751 A1 * 8/2012 Gasmen ..... F01D 17/162 415/213.1
2013/0202450 A1 * 8/2013 Ivakitch ..... F16D 1/076 416/248
2014/0010637 A1 * 1/2014 Pudvah ..... F01D 17/162 415/130
2014/0064875 A1 * 3/2014 Twell ..... F01D 17/10 411/116
2014/0072413 A1 * 3/2014 Do ..... F01D 17/162 415/157
2014/0219785 A1 * 8/2014 Gasmen ..... F01D 17/14 415/148
2015/0118027 A1 * 4/2015 Zieboli ..... F02B 37/186 415/145
2015/0377218 A1 * 12/2015 Trede ..... F03D 1/06 416/1
2016/0032759 A1 * 2/2016 Gasmen ..... F01D 17/162 415/148
2016/0123339 A1 * 5/2016 St. Mary ..... F01D 17/20 60/226.1
2016/0201499 A1 * 7/2016 Pudvah ..... F04D 29/563
2018/0080338 A1 * 3/2018 Kennedy ..... F04D 29/563
2018/0313222 A1 * 11/2018 Mena Dominguez .... B60S 1/02

* cited by examiner

VARIABLE-PITCH VANE ASSEMBLY

STATEMENT OF FEDERAL SUPPORT

This invention was made with Government support under contract FA8650-15-D-2502/0002 awarded by the Air Force. The Government has certain rights in the invention.

BACKGROUND

Exemplary embodiments pertain to the art of gas turbine engines. In particular, the present disclosure relates to variable-pitch vane systems of gas turbine engines.

Some portions of a gas turbine engine, including fan, low pressure compressor, high pressure compressor and turbine sections, may utilize stators or vanes with a variable pitch relative to the engine central axis. The variable pitch is often implemented using a sync ring, connected to each vane via a vane arm, and an actuator to drive rotation of the sync ring about the engine central axis. Rotation of the sync ring changes pitch of each of the vanes connected thereto via the vane arms.

The sync ring resides radially outboard of the vanes, in a cavity between the vanes and a fixed casing, for example, in the case of the turbine section, a turbine case, and radial space in such a cavity is limited. In addition, the radial height of the sync ring needs to allow for the installation thereof while avoiding case features, such as hooks or other features, so that the full vane ring assembly may be installed into engine position inside of the case.

BRIEF DESCRIPTION

In one embodiment, a variable-pitch vane assembly for a gas turbine engine includes a sync ring, a vane having a vane arm, and a pin installed through the sync ring and through the vane arm. The pin includes an anti-rotation notch located along a pin shaft. An anti-rotation spacer is engaged with the pin at the anti-rotation notch to prevent rotation of the pin.

Additionally or alternatively, in this or other embodiments a bushing is positioned between the vane arm and the pin.

Additionally or alternatively, in this or other embodiments there is a threaded connection between the bushing and the pin.

Additionally or alternatively, in this or other embodiments there is a threaded connection between the sync ring and the pin.

Additionally or alternatively, in this or other embodiments the pin has a recessed hexagonal head.

Additionally or alternatively, in this or other embodiments the anti-rotation spacer is located between a pin head and the vane arm.

Additionally or alternatively, in this or other embodiments, a locking tab washer retains the anti-rotation spacer at the anti-rotation notch.

Additionally or alternatively, in this or other embodiments the anti-rotation spacer has an L-shaped cross-section.

Additionally or alternatively, in this or other embodiments a first leg of the anti-rotation spacer engages the anti-rotation notch, and a second leg of the anti-rotation spacer abuts an outer ring surface of the sync ring.

In another embodiment, a turbine section of a gas turbine engine includes a turbine rotor and a turbine stator. The turbine stator includes one or more variable-pitch vane assemblies including a sync ring, a vane having a vane arm, and a pin installed through the sync ring and through the vane arm. The pin includes an anti-rotation notch located along a pin shaft. An anti-rotation spacer is engaged with the pin at the anti-rotation notch to prevent rotation of the pin.

Additionally or alternatively, in this or other embodiments a bushing is located between the vane arm and the pin.

Additionally or alternatively, in this or other embodiments there is a threaded connection between the bushing and the pin.

Additionally or alternatively, in this or other embodiments there is a threaded connection between the sync ring and the pin.

Additionally or alternatively, in this or other embodiments the pin has a recessed hexagonal head.

Additionally or alternatively, in this or other embodiments the anti-rotation spacer is located between a pin head and the vane arm.

Additionally or alternatively, in this or other embodiments, a locking tab washer retains the anti-rotation spacer at the anti-rotation notch.

Additionally or alternatively, in this or other embodiments the anti-rotation spacer has an L-shaped cross-section.

Additionally or alternatively, in this or other embodiments a first leg of the anti-rotation spacer engages the anti-rotation notch, and a second leg of the anti-rotation spacer abuts an outer ring surface of the sync ring.

In yet another embodiment, a method of assembling a variable-pitch vane assembly includes installing a pin through a sync ring and through a vane arm of a vane, and installing an anti-rotation spacer such that the anti-rotation spacer engages an anti-rotation notch at the pin to retain the pin at the sync ring and the vane arm.

Additionally or alternatively, in this or other embodiments installing the pin through the vane arm includes installing a bushing in a vane arm opening of the vane arm, and installing the pin into the bushing.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
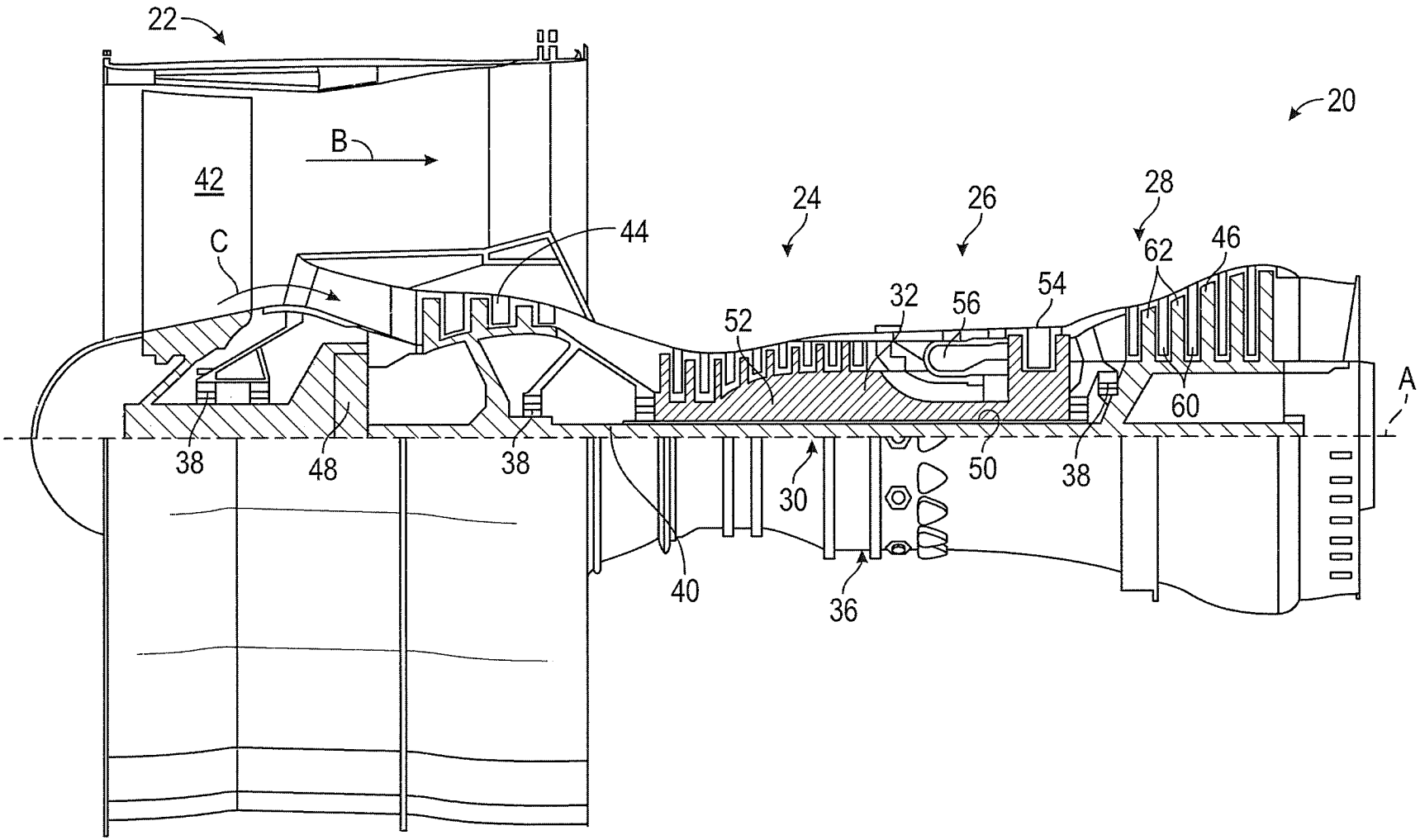
FIG. 1 is cross-sectional view of an embodiment of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine engine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded through the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,688 meters). The flight condition of 0.8 Mach and 35,000 ft (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 m/sec).

An embodiment of a low pressure turbine 46 includes one or more low turbine stators 60 arranged with one or more low turbine rotors 62. The low turbine rotors 62 are connected to the low speed spool 30 and rotate therewith.

Figure 2:
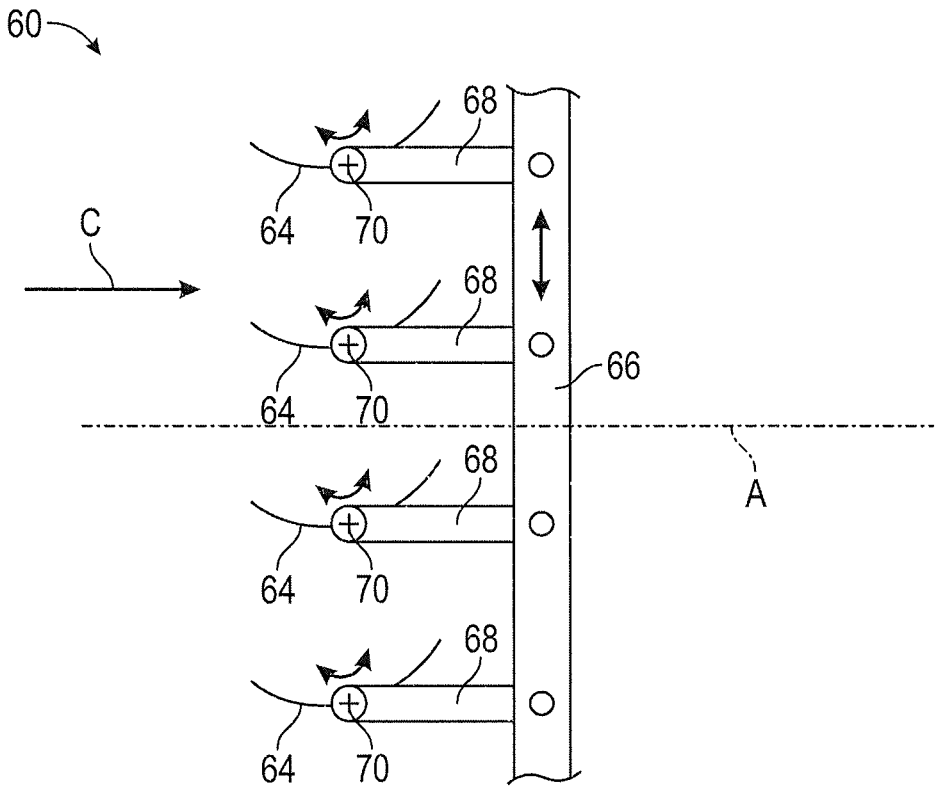
FIG. 2 is a schematic plan view of an embodiment of a variable-pitch vane stage of a gas turbine engine.

FIG. 2 illustrates a low turbine stator row 60, with a plurality of stator vanes 64. Each of the stator vanes 64 is connected to a sync ring 66 via a vane arm 68. The assembly is configured such that when the sync ring 66 is rotated circumferentially about the engine central longitudinal axis A, each of the stator vanes 64 rotates about a vane axis 70, thus varying a pitch of the vanes 64 relative to the core flow C. While described herein in the context of a low pressure turbine 46 of a gas turbine engine 20, one skilled in the art will readily appreciate that the present disclosure may be similarly applied to sync ring and vane arrangements in other sections of the gas turbine engine 20, for example, the fan section 42, the low pressure compressor 44, the high pressure compressor 52 or the high pressure turbine 54.

Figure 3:
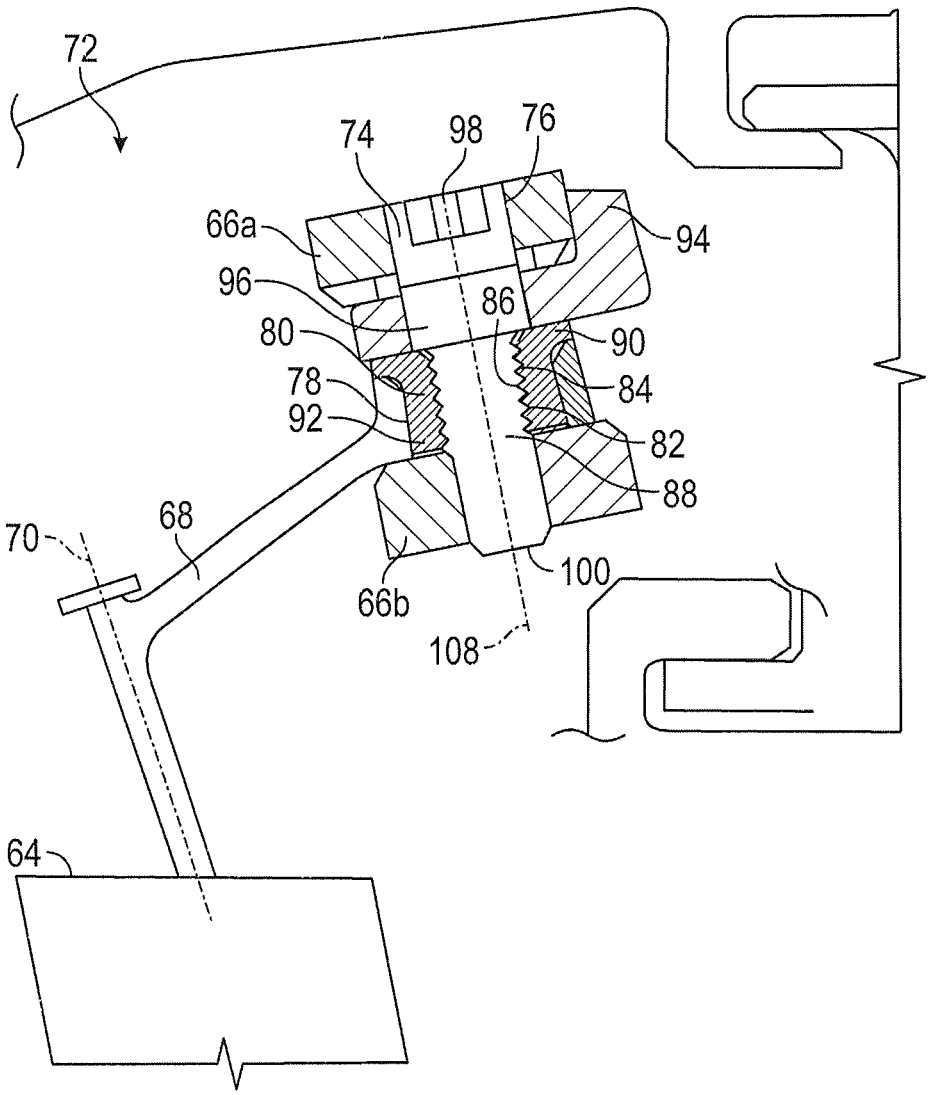
FIG. 3 is a schematic cross-sectional view of an embodiment of a variable-pitch vane assembly.

Referring now to FIG. 3, shown is a cross-sectional view of an embodiment of a variable-pitch vane assembly 72. The variable-pitch vane assembly 72 includes a vane 64 having a vane arm 68 extending therefrom to the sync ring 66. In the embodiment of FIG. 3, the sync ring 66 includes a first ring portion **66*a* and a second ring portion 66*b* offset from the first ring portion 66*a* and connected by a web portion (not shown) to the first ring portion 66*a*. To secure the vane arm 68 to the sync ring 66, a pin 74 is installed to the sync ring 66 through a sync ring opening 76 and at least partially through a vane arm opening 78. The vane arm opening 78 has a vane arm bushing 80 installed therein. The vane arm bushing 80 has one or more bushing threads 82 disposed along a bushing inner diameter 84, which engage pin threads 86 at a pin shaft 88. In some embodiments, the vane arm bushing 80 has a bushing head 90 extending from a bushing sleeve 92. While in some embodiments, the pin threads 86 engage bushing threads 82, one skilled in the art will appreciate that in other embodiments, the sync ring 66, either at the first ring portion 66*a* or the second ring portion 66*b* may include threads to engage the pin threads 86** and the bushing may be thread-less.

Further, an anti-rotation spacer 94 is positioned between the vane arm bushing 80 and the sync ring 66, and is configured to lock the position of the pin 74 once installed, preventing the pin threads 86 from backing out of the bushing threads 82, thereby retaining the pin 74 in the variable-pitch vane assembly 72, as will be explained in greater detail below.

Figure 4:
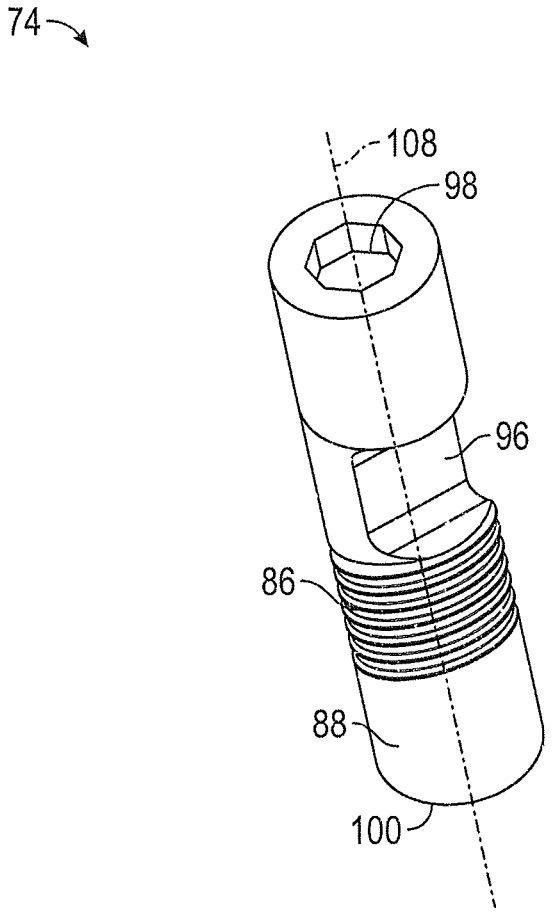
FIG. 4 is a perspective view of an embodiment of a pin for a variable-pitch vane assembly.

Referring now to FIG. 4, an embodiment of the pin 74 is shown. In addition to the pin threads 86 along the pin shaft 88, the pin 74 includes an anti-rotation notch 96 and a recessed hexagonal head 98, also known as an allen head. In the embodiment of FIG. 4, the anti-rotation notch 96 is located between the pin threads 86 and the head 98, but in other embodiments may be located at, for example, a location between the pin threads 86 and a pin tip 100.

Figure 5:
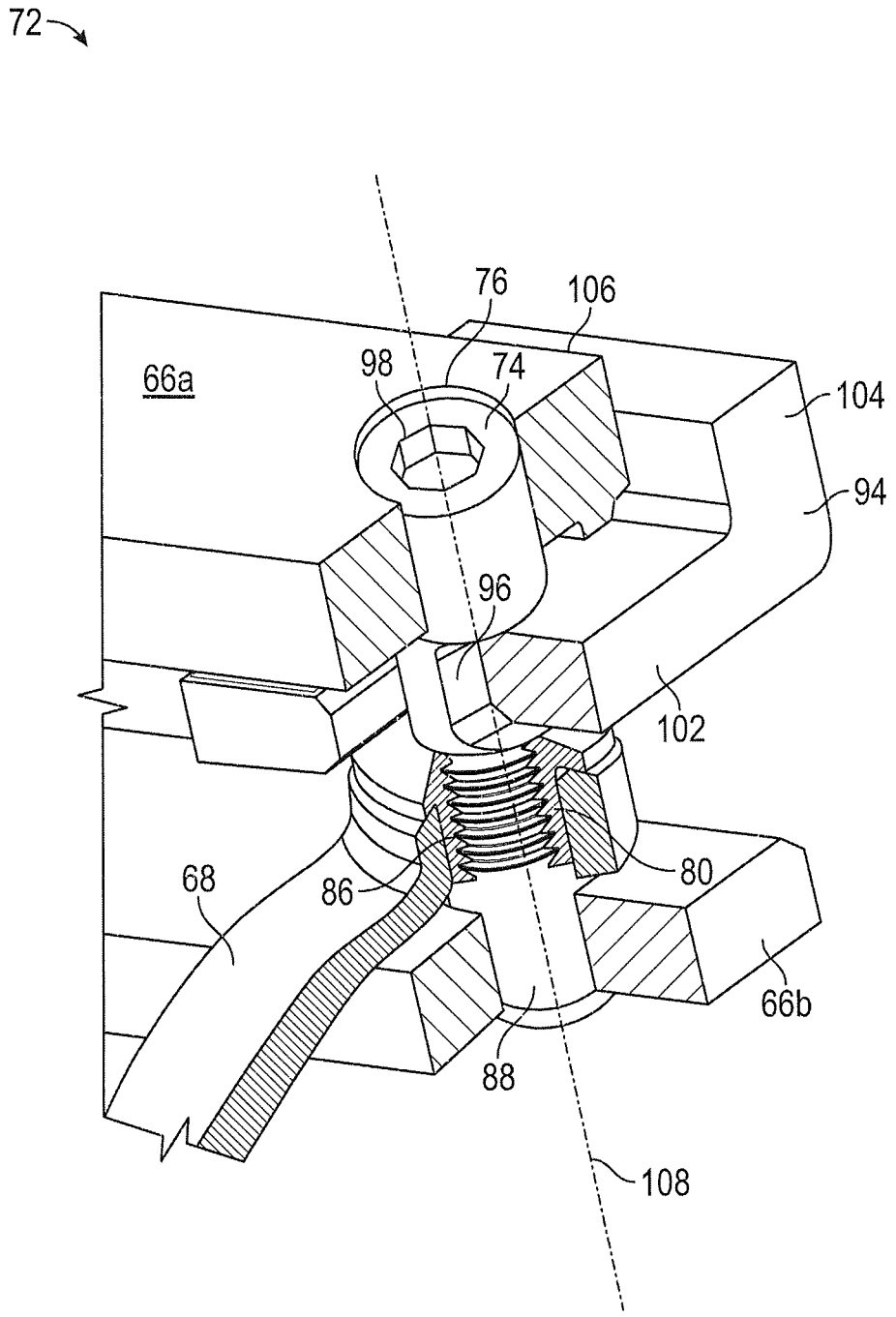
FIG. 5 is a partial cross-sectional view of an embodiment of a variable-pitch vane assembly.

FIG. 5 is a partial cross-sectional view of the variable-pitch vane assembly 72, and illustrates the assembly of the anti-rotation spacer 94 to the pin 74 in more detail. In the embodiment shown, the anti-rotation spacer 94 has an L-shaped cross-section, with a first leg 102 extending through the anti-rotation notch 96 in the pin 74, and a second leg 104 configured to abut an outer ring surface 106 of the first ring portion 66*a*. When installed the engagement of the second leg 104 to the outer ring surface 106 and the engagement of the first leg 102 to the anti-rotation notch 96 prevents rotation of the pin 74 about pin axis 108.

Figure 6:
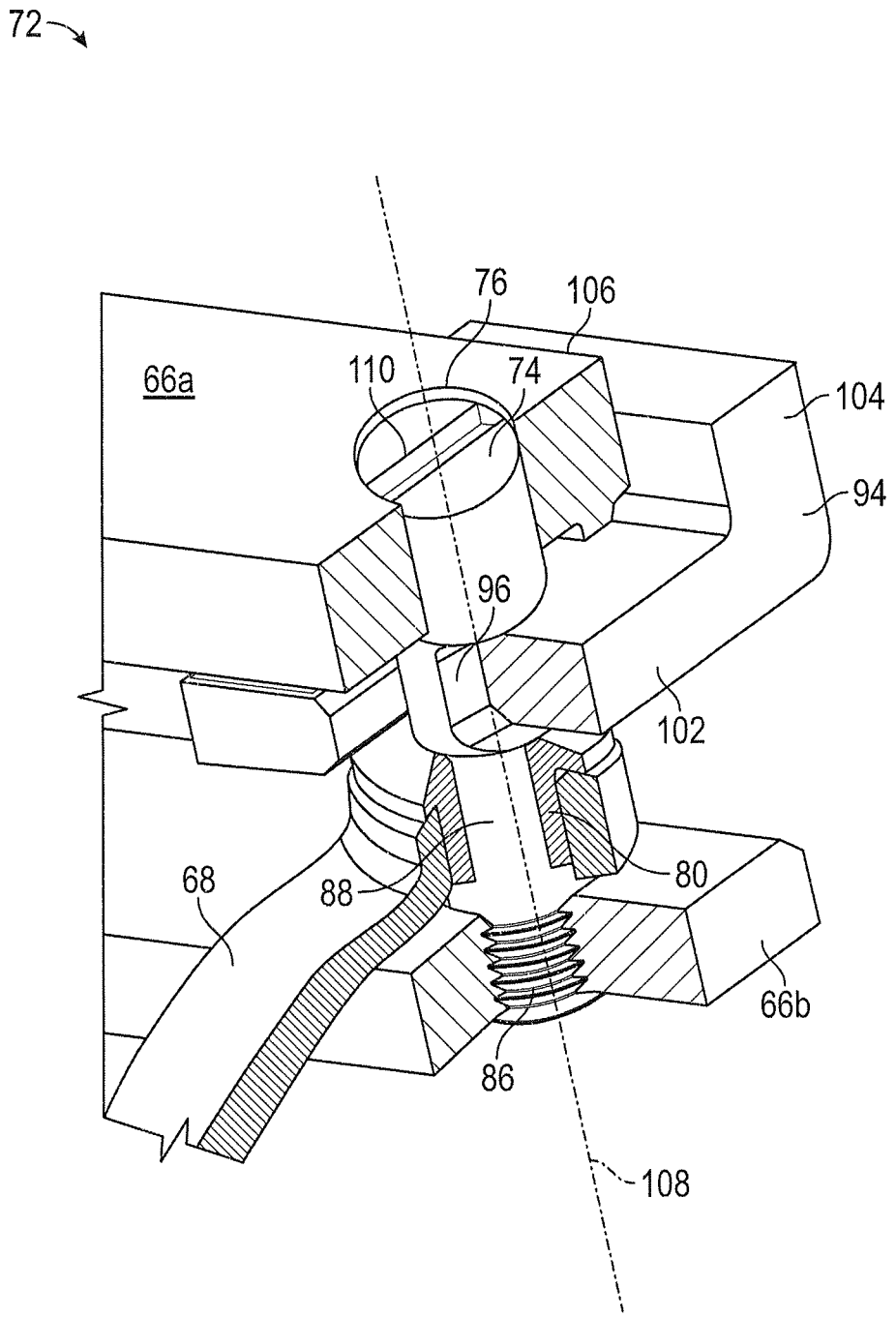
FIG. 6 is another partial cross-sectional view of an embodiment of a variable-pitch vane assembly.

Referring now to FIG. 6, another embodiment is illustrated in which the head of the pin 74 is a flat-head recessed head 110, and further illustrating the pin threads 86 engaging the second ring portion 66*b*. as stated above, in other embodiments the pin threads 86 may engage the first ring portion 66*a*, or alternatively the pin threads 86 may be eliminated, with the assembly relying on the engagement of the anti-rotation spacer 94 to the anti-rotation notch 96 to retain the pin 74 in position.

Figure 7:
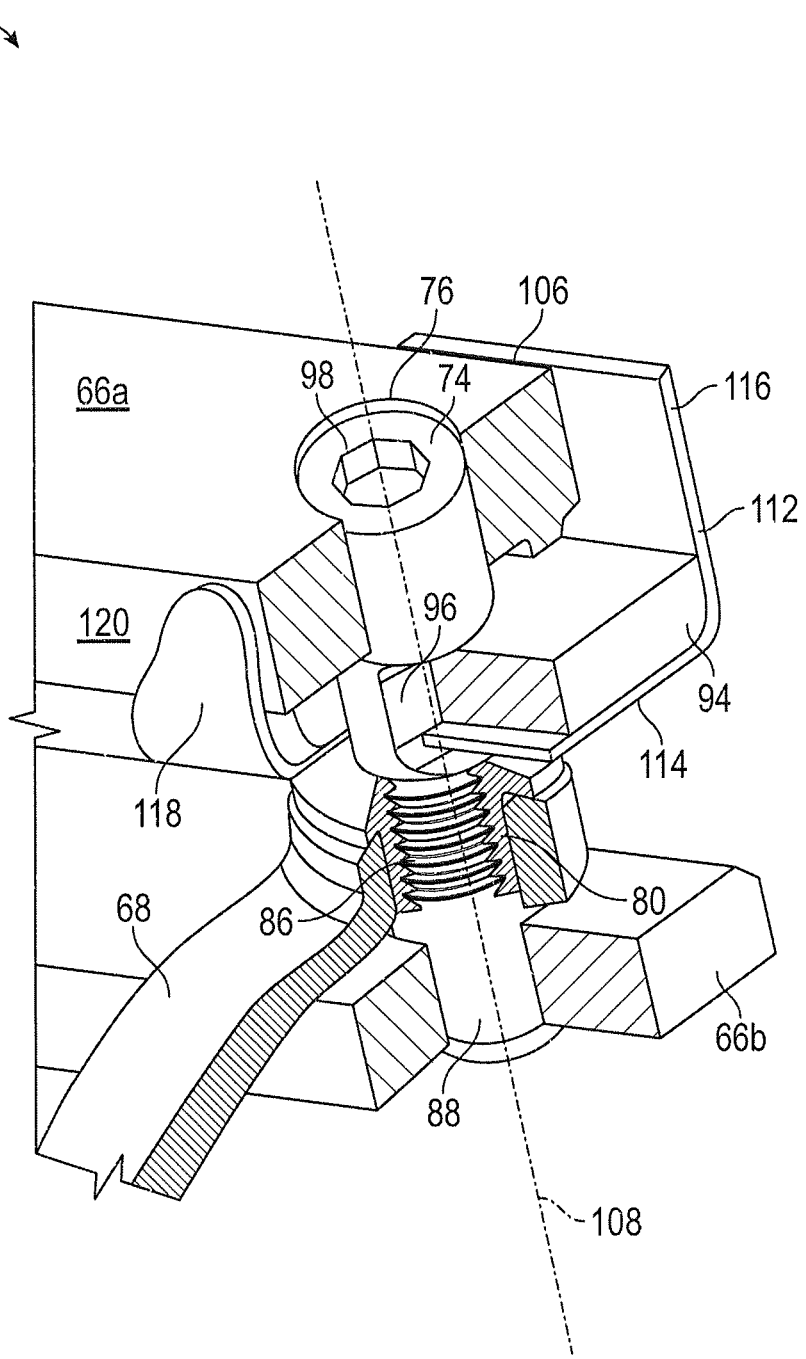
FIG. 7 is a partial cross-sectional view of another embodiment of a variable-pitch vane assembly.

In another embodiment, shown in FIG. 7, the anti-rotation spacer 94 is substantially flat, without an L-shaped cross-section, and a locking tab washer 112 is utilized to retain the prevent anti-rotation spacer 94 and prevent rotation of the anti-rotation spacer 94. The locking tab washer 112 has a base portion 114 installed between the anti-rotation spacer 94 and the vane arm 68, and a first tab 116 located at a first end of the base portion 114. The first tab 116 abuts the outer ring surface 106 when installed. In some embodiments, the first tab 116 is pre-bent prior to installation. The locking tab washer 112 further includes a second tab 118 located at a second end of the base portion 114, opposite the first end. The second tab 118 may be formed to its final shape upon installation to the variable-pitch vane assembly 72, so that the second tab 118 abuts an inner ring surface 120. The first tab 116 and the second tab 120 together retain the anti-rotation spacer 94 and prevent rotation thereof. Further, the locking tab washer 112 eliminates the need to weld or otherwise secure the anti-rotation spacer 94 to the first ring portion 66*a*, thus making disassembly, if needed, easier. In some embodiments, the locking tab washer 112 engages with the anti-rotation notch 96.

Figure 8:
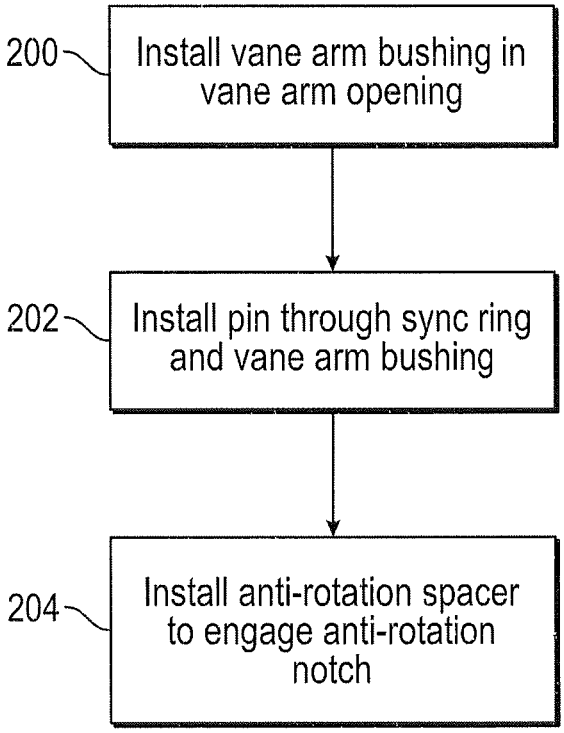
FIG. 8 is an illustration of a method of assembly of a variable-pitch vane assembly.

With reference to FIG. 8, a method of assembling a variable-pitch vane assembly will now be described. In block 200, the vane arm bushing 80 is installed in the vane arm opening 78. At block 202, the pin 74 is installed through the sync ring 66 and the vane arm bushing 80. At block 204, the anti-rotation spacer 94 is installed, with the first leg 202 engaging the anti-rotation notch 96 of the pin 74.

The present disclosure provides a relatively low-profile and simplified installation, relative to the traditional nut and bolt assembly. The low-profile, compact configuration allows the assembly to fit into compact spaces and allowing ample clearance for installation around casing features of the gas turbine engine.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A variable-pitch vane assembly for a gas turbine engine, comprising:

a sync ring;

a vane having a vane arm;

a pin installed through the sync ring and through the vane arm, the pin including an anti-rotation notch disposed along a pin shaft; and an anti-rotation spacer engaged with the pin at the anti-rotation notch to prevent rotation of the pin;

wherein the pin has a threaded connection with one of the sync ring or a bushing disposed between the vane arm and the pin.

2. The variable-pitch vane assembly of claim 1, wherein the pin has a recessed hexagonal head.

3. The variable-pitch vane assembly of claim 1, wherein the anti-rotation spacer is disposed between a pin head and the vane arm.

4. The variable-pitch vane assembly of claim 1, further comprising a locking tab washer to retain the anti-rotation spacer at the anti-rotation notch and/or engage with the anti-rotation notch.

5. The variable-pitch vane assembly of claim 1, wherein the anti-rotation spacer has an L-shaped cross-section.

6. The variable-pitch vane assembly of claim 5, wherein a first leg of the anti-rotation spacer engages the anti-rotation notch, and a second leg of the anti-rotation spacer abuts an outer ring surface of the sync ring.

7. A turbine section of a gas turbine engine, comprising:

a turbine rotor; and a turbine stator, the turbine stator including one or more variable-pitch vane assemblies including:

a sync ring;

a vane having a vane arm;

a pin installed through the sync ring and through the vane arm, the pin including an anti-rotation notch disposed along a pin shaft; and an anti-rotation spacer engaged with the pin at the anti-rotation notch to prevent rotation of the pin;

wherein the pin has a threaded connection with one of the sync ring or a bushing disposed between the vane arm and the pin.

8. The turbine section of claim 7, wherein the pin has a recessed hexagonal head.

9. The turbine section of claim 7, wherein the anti-rotation spacer is disposed between a pin head and the vane arm.

10. The turbine section of claim 7, further comprising a locking tab washer to retain the anti-rotation spacer at the anti-rotation notch.

11. The turbine section of claim 7, wherein the anti-rotation spacer has an L-shaped cross-section.

12. The turbine section of claim 11, wherein a first leg of the anti-rotation spacer engages the anti-rotation notch, and a second leg of the anti-rotation spacer abuts an outer ring surface of the sync ring.

13. A method of assembling a variable-pitch vane assembly, comprising:

installing a pin through a sync ring and through a vane arm of a vane; and installing an anti-rotation spacer such that the anti-rotation spacer engages an anti-rotation notch at the pin to retain the pin at the sync ring and the vane arm;

wherein the pin has a threaded connection with one of the sync ring or a bushing disposed between the vane arm and the pin.

14. The method of claim 13, wherein installing the pin through the vane arm includes:

installing a bushing in a vane arm opening of the vane arm; and installing the pin into the bushing.

* * * * *